US007552668B1

(12) United States Patent
Gonzalez

(10) Patent No.: US 7,552,668 B1
(45) Date of Patent: Jun. 30, 2009

(54) ROTARY BULLET FEEDER AND TOOLHEAD ASSEMBLIES FOR USE WITH PROGRESSIVE CARTRIDGE RELOADING MACHINES

(76) Inventor: Xavier G. Gonzalez, 2525 E. Omega Cir., Mesa, AZ (US) 85213

( * ) Notice: Subject to any disclaimer, the term of this patent is extended or adjusted under 35 U.S.C. 154(b) by 368 days.

(21) Appl. No.: 11/702,784

(22) Filed: Feb. 5, 2007

(51) Int. Cl.
*F42B 33/00* (2006.01)

(52) U.S. Cl. ..... 86/45

(58) Field of Classification Search ..... 86/24, 86/27, 31, 45, 46
See application file for complete search history.

(56) References Cited

U.S. PATENT DOCUMENTS

| | | | | |
|---|---|---|---|---|
| 1,398,106 | A * | 11/1921 | McGee | 86/23 |
| 2,371,126 | A * | 3/1945 | Best et al. | 86/54 |
| 3,659,492 | A * | 5/1972 | Fullmer | 86/46 |
| 4,312,438 | A | 1/1982 | Vatsvog | |
| 6,041,687 | A | 3/2000 | Fowler | |
| 7,497,155 | B2 * | 3/2009 | Koskela | 86/45 |
| 2004/0025678 | A1 * | 2/2004 | Shields | 86/31 |
| 2008/0053296 | A1 * | 3/2008 | Koskela | 86/24 |
| 2008/0053297 | A1 * | 3/2008 | Koskela | 86/27 |

* cited by examiner

*Primary Examiner*—Troy Chambers
(74) *Attorney, Agent, or Firm*—William E. Hein

(57) ABSTRACT

Rotary bullet feeder and toolhead assemblies for use with commercially available progressive cartridge reloading machines automatically supply correctly-oriented bullets to a bullet seating die position thereof. The rotary bullet feeder assembly randomly collects hoppered bullets in a desired orientation in a multiplicity of bullet pockets formed along the peripheral edge of a rotating bullet feed ring. An arcuate bullet wall prevents gravitational release of the bullets contained in the bullet pockets until each of the bullet pockets, in turn, reaches the apex point along its circular route of travel, at which point an opening in the bullet wall allows a bullet to fall into a bullet guide for gravitational descent to a toolhead assembly. The toolhead assembly includes a toolhead plate for receiving the rotary bullet feeder assembly and a flat circular bullet feedwheel mounted for rotation on the underside of the toolhead plate. The bullet feedwheel includes a plurality of bullet feed holes equidistantly arranged in a circle proximate the peripheral edge of the bullet feedwheel. An indexing mechanism, positioned beneath the bullet feedwheel, serves to incrementally rotate or index the bullet feedwheel in response to each user actuation of the handle of the cartridge reloading machine. Each incremental indexing rotation of the bullet feedwheel serves to sequentially advance each bullet feed hole containing a bullet received from the rotary bullet feeder assembly into alignment with a conventional seating die positioned in the toolhead plate.

15 Claims, 10 Drawing Sheets

ROTARY BULLET FEEDER AND TOOLHEAD ASSEMBLIES FOR USE WITH PROGRESSIVE CARTRIDGE RELOADING MACHINES

BACKGROUND AND SUMMARY OF THE INVENTION

This invention relates generally to ammunition reloading machines and, more particularly, to a rotary bullet feeder assembly and a toolhead assembly for enhancing the operation of such ammunition reloading machines.

Reloading one's ammunition began years ago in an effort by shooters to research and develop special ammunition, rather than settle for off-the-shelf ammo. An ammunition cartridge includes a cartridge case, a primer, a charge of smokeless powder, and a bullet. After a cartridge has been fired and discharged, it cannot be reused. As a result, those who frequent the shooting ranges accumulate buckets of used empty brass cartridge cases. In the early days, cartridge reloading was accomplished by a time consuming handload process. This process involved 1) resizing the used empty cases so that they will again fit into the firearm chamber; 2) removing the old primer from the case; 3) cleaning the case; 4) reforming the mouth of the case to accept a new bullet; 5) installing a new primer; 6) weighing a charge of smokeless powder; 7) filling the case using a special funnel and powder pan; 8) installing the new bullet to a specific loaded length; and 9) crimping the case mouth around the bullet if required by the type of ammunition being reloaded. Until the mid-1970's, most companies in the ammunition reloading industry produced only handloading products that included single stage presses, reloading die sets, powder scales, case preparation tools, and cleaning kits. While effective, these products permitted reloading of only a single cartridge case at a time. Thus, it took hours to prepare and reload a box of cartridges.

With the rapid growth of competition shooting in the early 1980's came a new era in ammunition reloading known as "progressive reloading." Progressive reloading machines enabled competition shooters and weekend hobby shooters to reload large quantities of ammunition fast and accurately. The progressive reloading machines simultaneously performed many of the separate operations of handloading. Each complete cycle of the operating handle of one of these machines produces a finished round of ammunition. Representative of the progressive reloading machines on the market today is the XL650 manufactured by Dillon Precision Products. The XL650 is a five-station reloading machine that provides automatic casefeed in advance of station one. A hopper holds 100-200 empty cartridge cases that are conveyed into a columnar feed tube by an electric motor. When the operating handle of the XL650 is moved downward, a platform travels upward, moving the cartridge cases up to the reloading dies. At the same time, a cam-activated casefeed mechanism transfers one empty case from the feed tube to station one. Station one resizes the case and removes the spent primer. At station two, the case mouth is prepared to accept a new bullet, and a charge of powder is automatically dispensed into the case. A primer feed system, adjacent to station two, holds up to 100 new primers in a metal feed tube. A cam and lever mechanism rotates the primer feed wheel, thereby advancing a new primer below the shellplate into the station two position. Station three is an inspection stage, at which the dispensed powder is checked. At station four, a new bullet manually placed on the case mouth is seated into the cartridge case. At final station five, the case mouth is crimped around the bullet. Next, the handle of the reloading machine is returned to its original rest position, moving the platform downward. At the same time, the circular shellplate, which holds five cartridge cases, rotates automatically, advancing the group of cartridge cases to the next station. An empty cartridge case moves down a track and into station one. At the same time, the cartridge case advancing to station two receives a new primer upon its arrival. The cartridge case with a new primer advances to station three. That cartridge case then advances to station four, at which the operator manually places a new bullet on the mouth of the cartridge case. The cartridge case with the bullet installed then advances to station five. After the mouth of the cartridge case has been crimped around the bullet at station five, the completed cartridge is ejected out of the shellplate for travel down a ramp and into a collection bin. All of the previously described reloading steps occur during movement of the reloading machine handle from a rest position downward to a stop position, at which movement is paused to permit insertion of a primer into the cartridge case at station two. Also, while at the stop position, a bullet is manually placed on the mouth of the cartridge case at station four, following which the handle is moved upward to return it to its rest position, thereby completing the cartridge reloading process.

While progressive reloading machines represent a significant labor saving over previous handloading, they still require manual placement of a bullet on the mouth of each cartridge as it arrives at the appropriate machine station. Not only is this task time consuming and very tedious during a session in which several hundred cartridge cases are being reloaded, but operators of these machines invariably suffer pinched fingers caused by even the slightest delay in removing them before the cartridge case mouth crimping action takes place. In addition, the use of existing progressive reloading machines becomes even more time consuming for those operators who don't have the use of their left hand or arm and are therefore forced to use the right hand and arm for both operation of the machine handle and manual placement of a bullet on the mouth of each cartridge case as it is reloaded.

It would therefore be advantageous to provide rotary bullet feeder and toolhead assemblies for use with commercially available progressive cartridge reloading machines that serve to automatically deliver properly-oriented bullets to the seating die position thereof.

In accordance with one illustrated preferred embodiment of the present invention, a rotary bullet feeder assembly randomly collects hoppered bullets in a desired orientation in a multiplicity of bullet pockets formed along the peripheral edge of a rotating bullet feed ring. An arcuate bullet wall prevents gravitational release of the bullets contained in the bullet pockets until each of the bullet pockets, in turn, reaches the apex point along its circular route of travel, at which point an opening in the bullet wall allows a bullet to fall into a bullet guide for gravitational descent to a bullet exit opening in the bullet guide.

In accordance with a further illustrated preferred embodiment of the present invention, bullets exiting the rotary bullet feeder assembly are delivered to a toolhead assembly employed in a conventional, commercially available progressive cartridge reloading machine. The toolhead assembly includes a toolhead plate for receiving the rotary bullet feeder assembly and a flat circular bullet feedwheel mounted for rotation on the underside of the toolhead plate. The bullet feedwheel includes a plurality of bullet feed holes equidistantly arranged in a circle proximate the peripheral edge of the bullet feedwheel. An indexing mechanism, positioned beneath the bullet feedwheel, serves to incrementally rotate or index the bullet feedwheel in response to each user actuation of the handle of the cartridge reloading machine. Each incremental indexing rotation of the bullet feedwheel serves to sequentially advance the position of each bullet feed hole containing a bullet received from the rotary bullet feeder assembly into alignment with a conventional seating die positioned in the toolhead plate.

The combination of the rotary bullet feeder assembly and the toolhead assembly of the present invention eliminates the time-consuming and otherwise disadvantageous need for manually placing a correctly oriented bullet on the mouth of each cartridge case to be reloaded, as has been required by cartridge reloading machines in the past.

DESCRIPTION OF THE PREFERRED EMBODIMENTS

Figure 1:
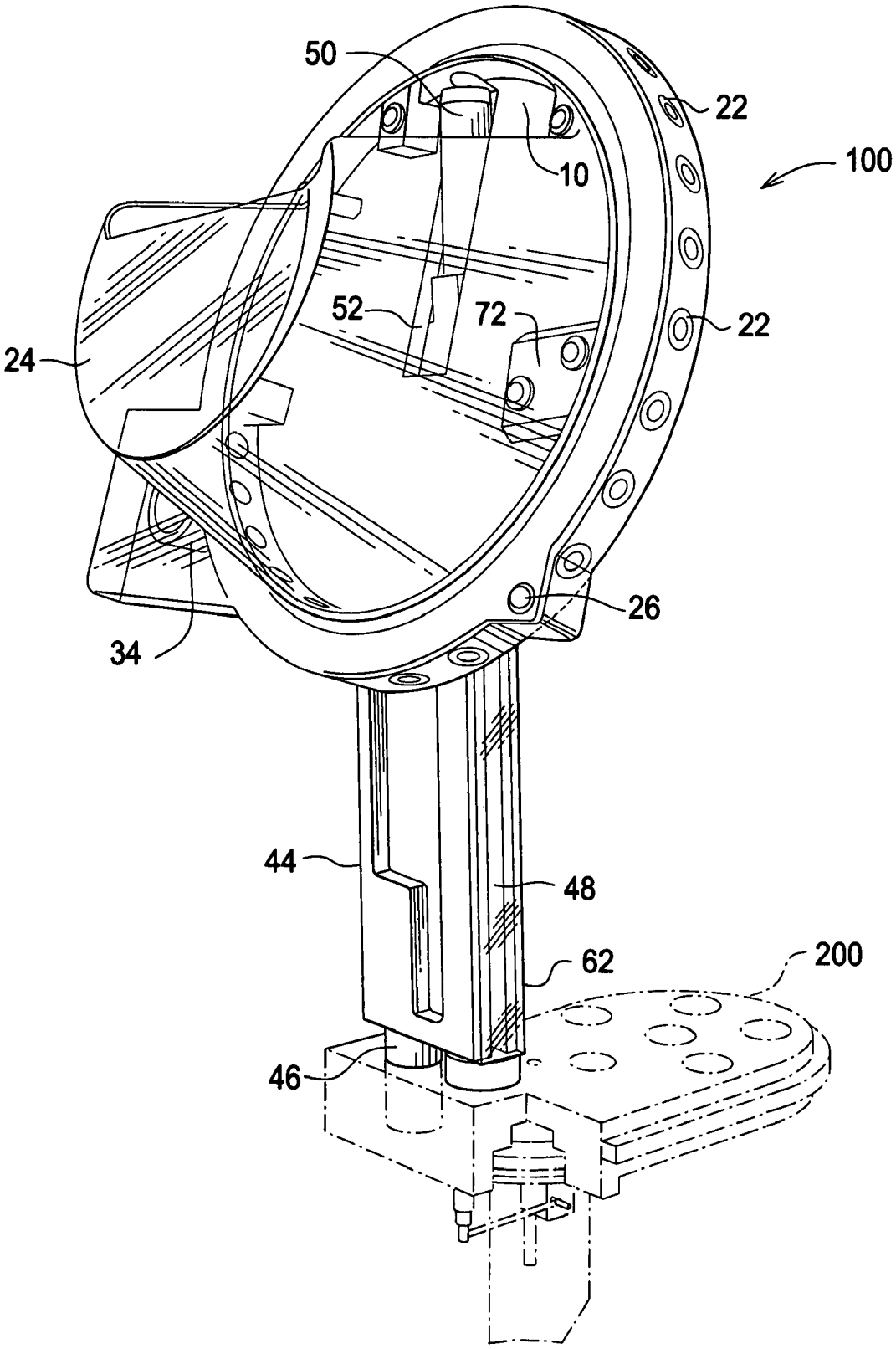
FIG. 1 is a pictorial diagram of the rotary bullet feeder assembly of the present invention shown coupled to a toolhead assembly that may be installed in a typical commercially available progressive cartridge reloading machine.
Figure 2:
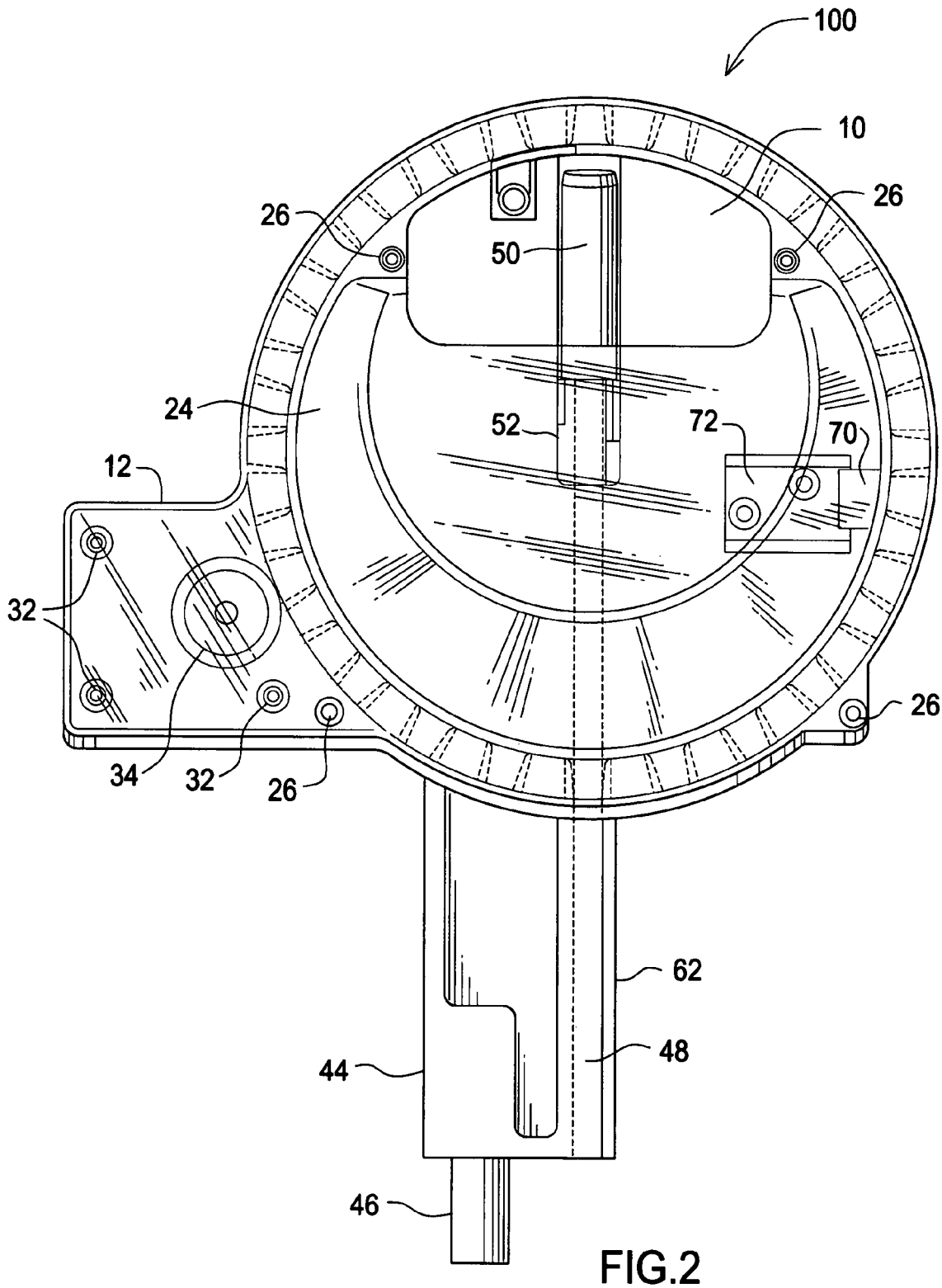
FIG. 2 is a front elevation view of the rotary bullet feeder assembly of FIG. 1.

Referring now to FIG. 1, there is shown a rotary bullet feeder assembly 100 in accordance with the present invention, coupled to a toolhead assembly 200 that may be installed in a typical commercially available progressive cartridge reloading machine. The cartridge reloading machine, while utilizing applicant's important rotary bullet feeder assembly, does not form part of the present invention.

Referring additionally to FIGS. 2-7, bullet feeder assembly 100 includes a generally circular flat base plate 10 having a flange portion 12 extending to the left thereof. Base plate 10 may be fabricated of aluminum or any other rigid material. A low voltage reversible DC motor 30 of the type readily commercially available is conventionally mounted on the rear surface of flange portion 12 of base plate 10 by means of bolts or other conventional mounting hardware at locations 32. A circular raised boss 14 is formed on the front surface of base plate 10 and is spaced inwardly uniformly from the circular periphery of base plate 10. The upper portion of boss 14, subtending an arc of approximately 180 degrees, extends further forward from base plate 10 so as to form an arcuate bullet support wall 16. A circular bullet feed ring 18 that may be fabricated of plastic or other desired material, is positioned over, and supported for rotation by, boss 14 and bullet support wall 16. The outside diameter of the bullet feed ring 18 is approximately the same as the outside diameter of the base plate 10. The inside diameter of the bullet feed ring 18 adjacent the rear surface thereof is such as to bear against the raised boss 14 on the front surface of base plate 10. The inside diameter of the forward portion of the bullet feed ring 18 is slightly greater than the inside diameter of the rearward portion of bullet feed ring 18 that bears against the raised boss 14, thus forming a step between the forward and rearward inner surfaces of bullet feed ring 18. Twenty-four equidistantly-spaced holes 20 extend through bullet feed ring 18 from the stepped forward inner surface thereof to the outer surface thereof. A circular insert 22, open at both ends, is installed in each of the holes 20 to form a bullet pocket 22 for retaining bullets 80 being fed by bullet feeder assembly 100. The inner surface of each of the inserts 22 is tapered toward the outer surface of bullet feed ring 18 so that bullets 80, positioned in the inserts 22 nose first, appear to be encapsulated and fully seated within the inserts 22. To that end, the inner surface of each of the inserts 22 may be conformed to the outer surface of the bullets being fed, if desired.

A bullet hopper bowl 24, peripherally shaped in general correspondence with base plate 10, is attached over base plate 18 and bullet feed ring 18 at locations 26 using conventional hardware. Bullet hopper bowl 24 is preferably constructed of a transparent plastic material. A urethane drive roller 34, driven by motor 30, is positioned for contacting the outer peripheral surface of bullet feed ring 18 and serves to frictionally drive bullet feed ring 18.

Figure 7:
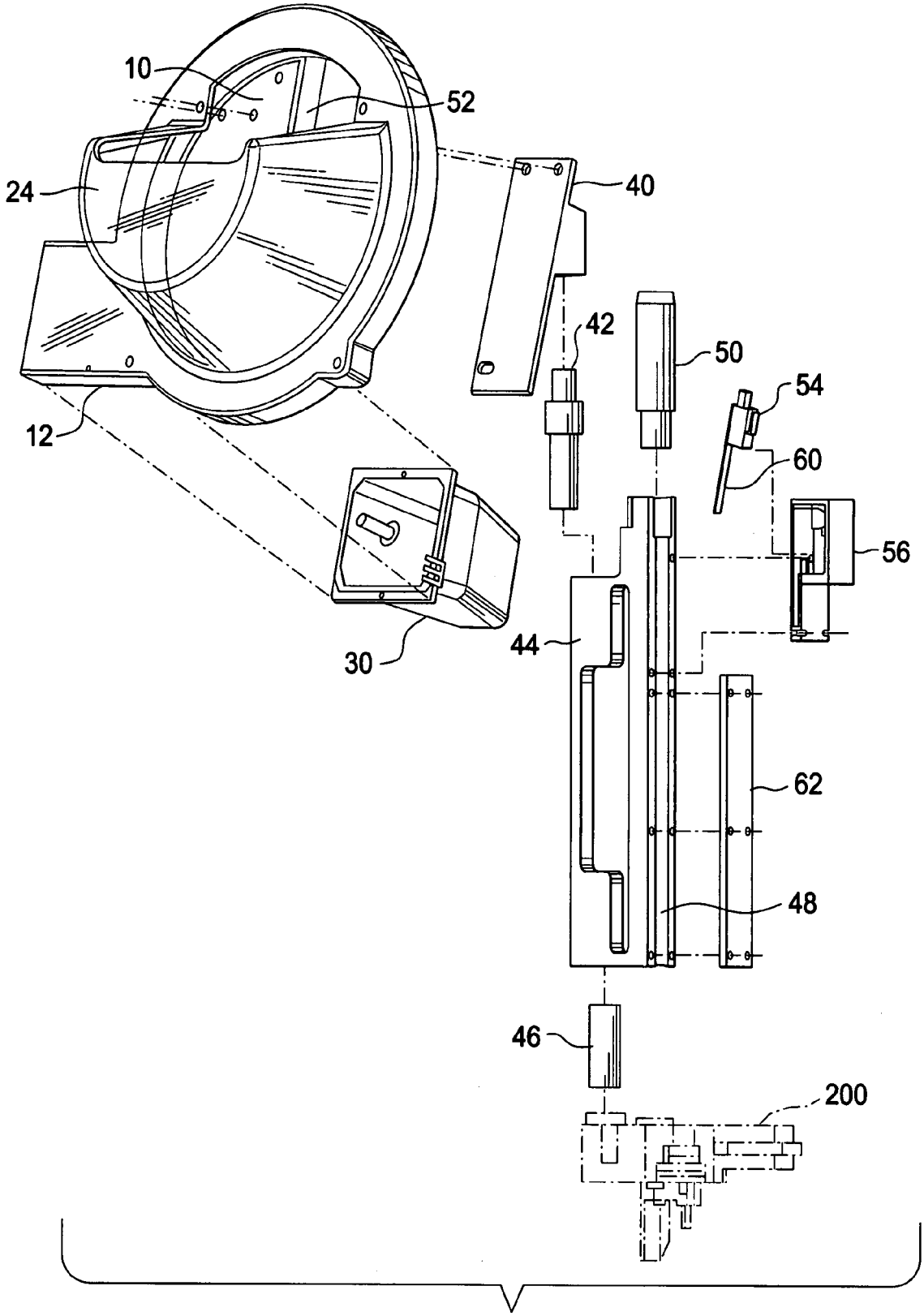
FIG. 7 is an exploded view of the rotary bullet feeder assembly of FIGS. 1-3, illustrating the major components thereof.
Figure 9:
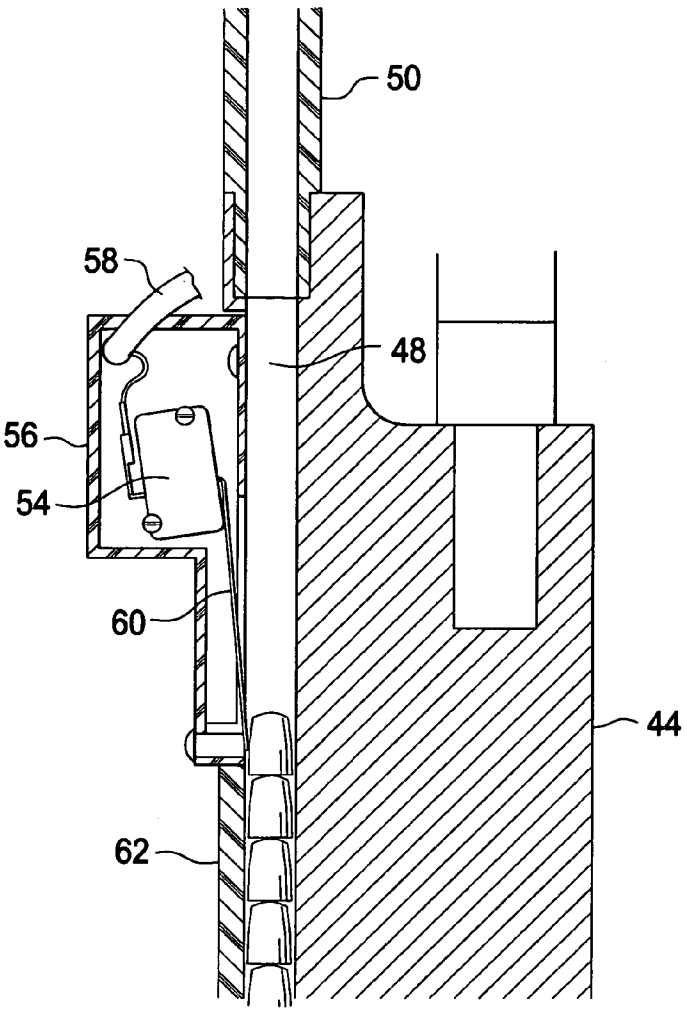
FIG. 9 illustrates the position of the microswitch lever of FIG. 8 that interrupts operation of the feed motor when the feed tube is full below the microswitch lever.
Figure 8:
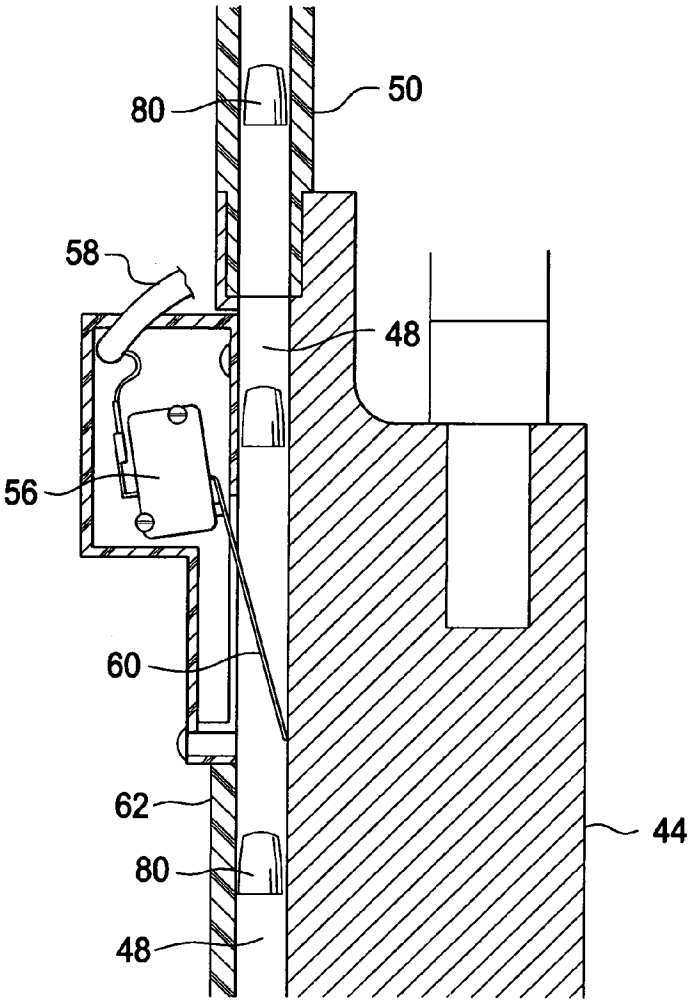
FIG. 8 is a cross-sectional view of a portion of the bullet feed tube of the rotary bullet feeder assembly of FIGS. 1-3, illustrating a feed motor controlling microswitch that permits the gravitational filling of bullets into the feed tube.
Figure 11:
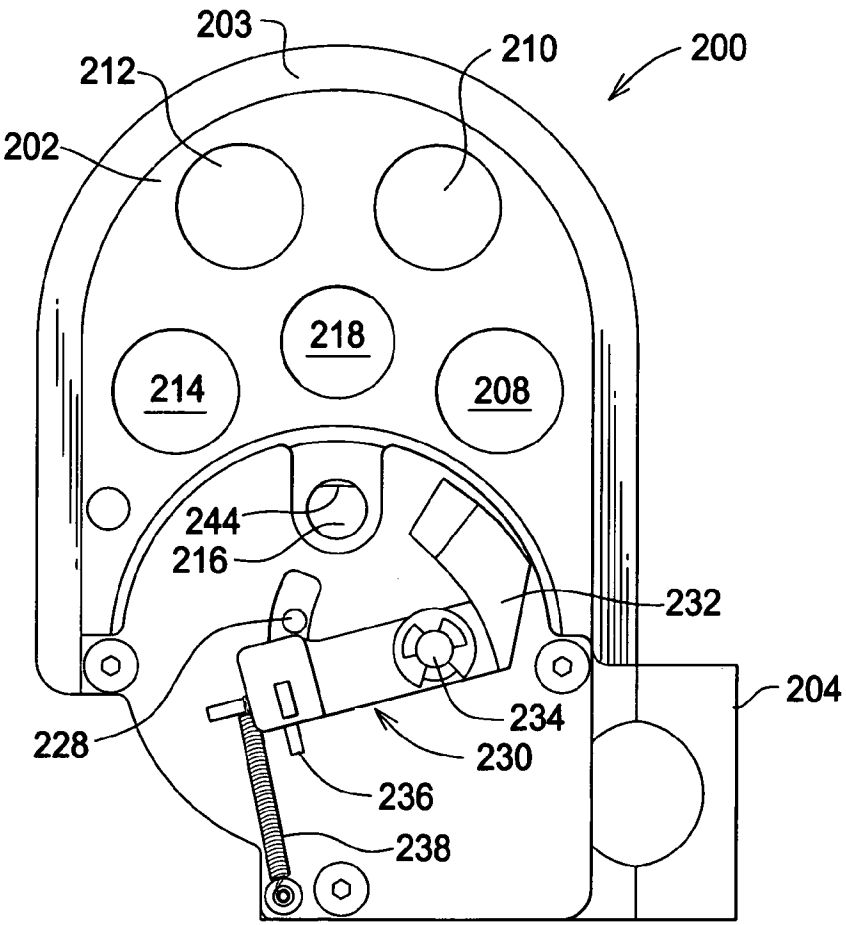
FIG. 11 is a bottom plan view of the toolhead assembly of FIGS. 1 and 10.
Figure 10:
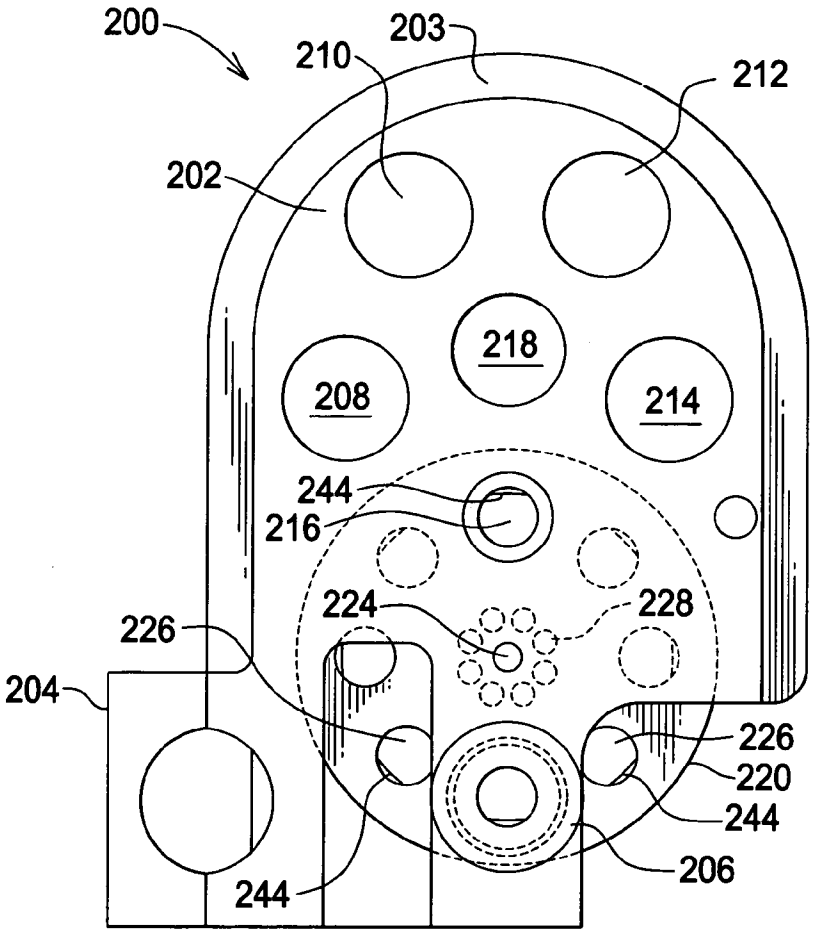
FIG. 10 is a top plan view of the toolhead assembly shown in phantom in FIG. 1 that is installed in a typical commercially available progressive cartridge reloading machine and to which the rotary bullet feeder assembly of FIGS. 1-3 is coupled.
Figure 12:
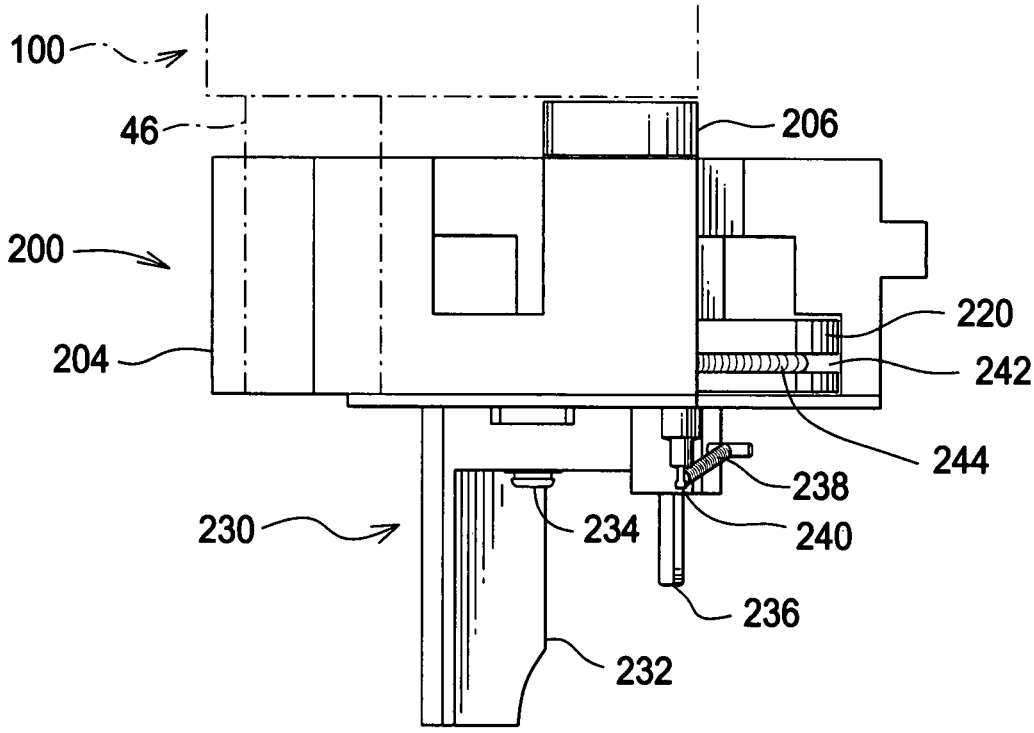
FIG. 12 is a front elevation view of the toolhead assembly of FIGS. 1, 10, and 11.
Figure 13:
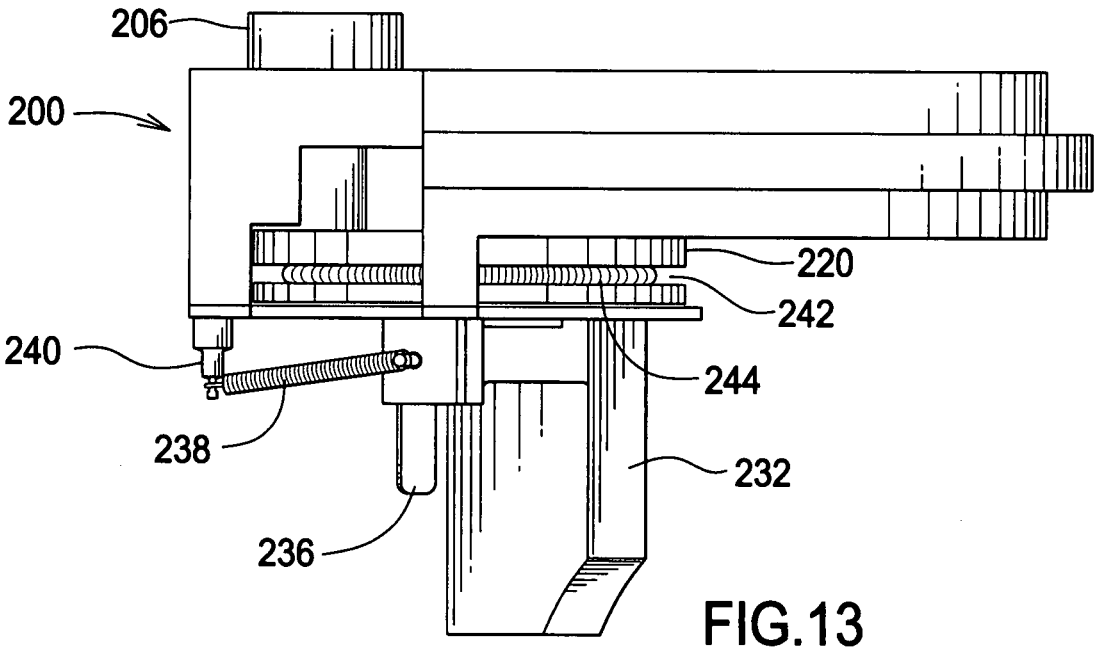
FIG. 13 is a right side elevation view of the toolhead assembly of FIGS. 1 and 10-12.
Figure 14:
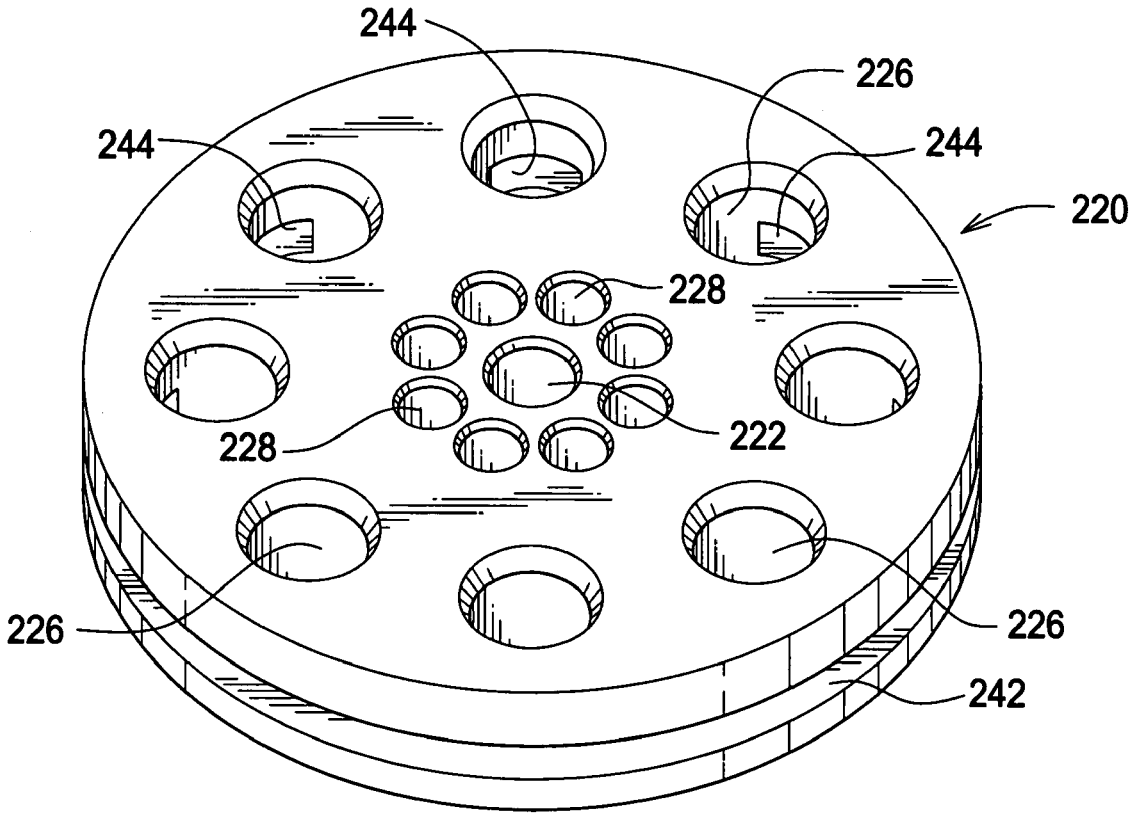
FIG. 14 is a pictorial diagram of the bullet feed wheel employed in the toolhead assembly of FIGS. 1 and 10-13.

As illustrated in FIG. 7, a mounting bracket 40 is fastened to the rear surface of base plate 10 to maintain base plate 10, as well as bullet feed ring 18 and bullet hopper bowl 24, connected thereto, in a fixed position tilted slightly rearwardly from the vertical. A vertically-depending solid circular bracket post 42 is retained by mounting bracket 40. An elongated aluminum bullet guide 44 is coupled to the bottom portion of circular bracket post 42 so as to depend therefrom. A solid circular mounting post 46 is connected in axial alignment with bracket post 42 at the bottom of bullet guide 44. Mounting post 46 serves to mount the rotary bullet feeder assembly 100 in a vertical position above toolhead assembly 200 of a commercially available progressive cartridge reloading machine or other bullet feeding destination apparatus. Bullet guide 44 includes a generally circular vertically-oriented bullet cavity 48 aligned parallel to the axis of bracket post 42 and of mounting post 46. The bottom end of a cylindrical plastic bullet funnel 50 is inserted into the top of bullet cavity 48. The top portion of the bullet funnel 50 extends upward into a vertical slot 52 in base plate 10. With particular reference to FIGS. 7-9, a microswitch 54 is mounted within a switch box 56 positioned alongside bullet cavity 48 near the top thereof. Microswitch 54 is electrically connected via a cable 58 to motor 30. A microswitch lever 60 is free to move from one side to the other of bullet cavity 48. A transparent plastic cover 62 is positioned over the length of bullet cavity 48 from the switch box 56 to the lower end of bullet cavity 48 at which bullets 80 exit bullet cavity 48.

Figure 3:
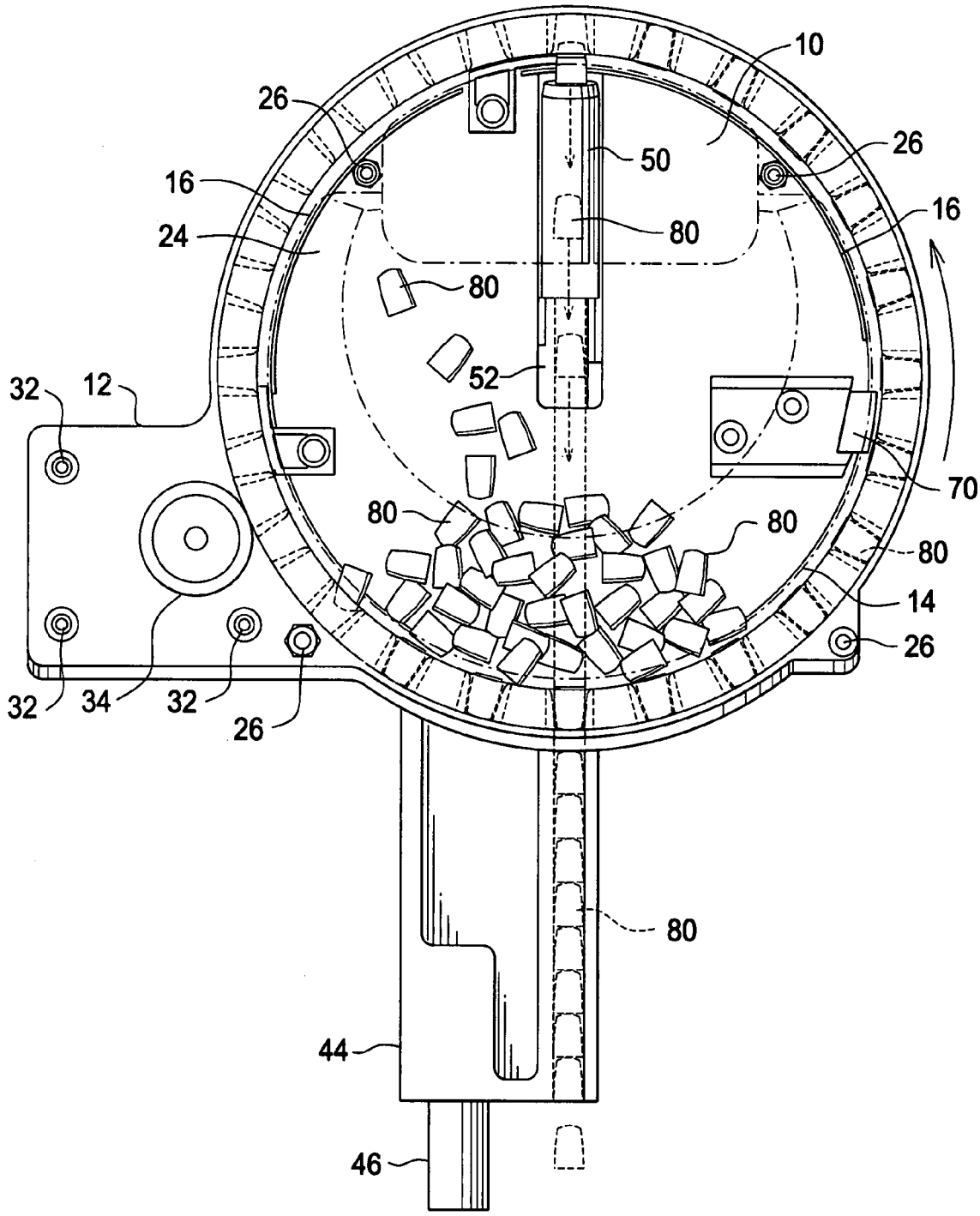
FIG. 3 illustrates the rotary bullet feeder assembly of FIGS. 1 and 2 and the way in which bullets placed in a clear plastic hopper thereof are gravitationally loaded into bullet pockets of a rotating feed ring.
Figure 4:
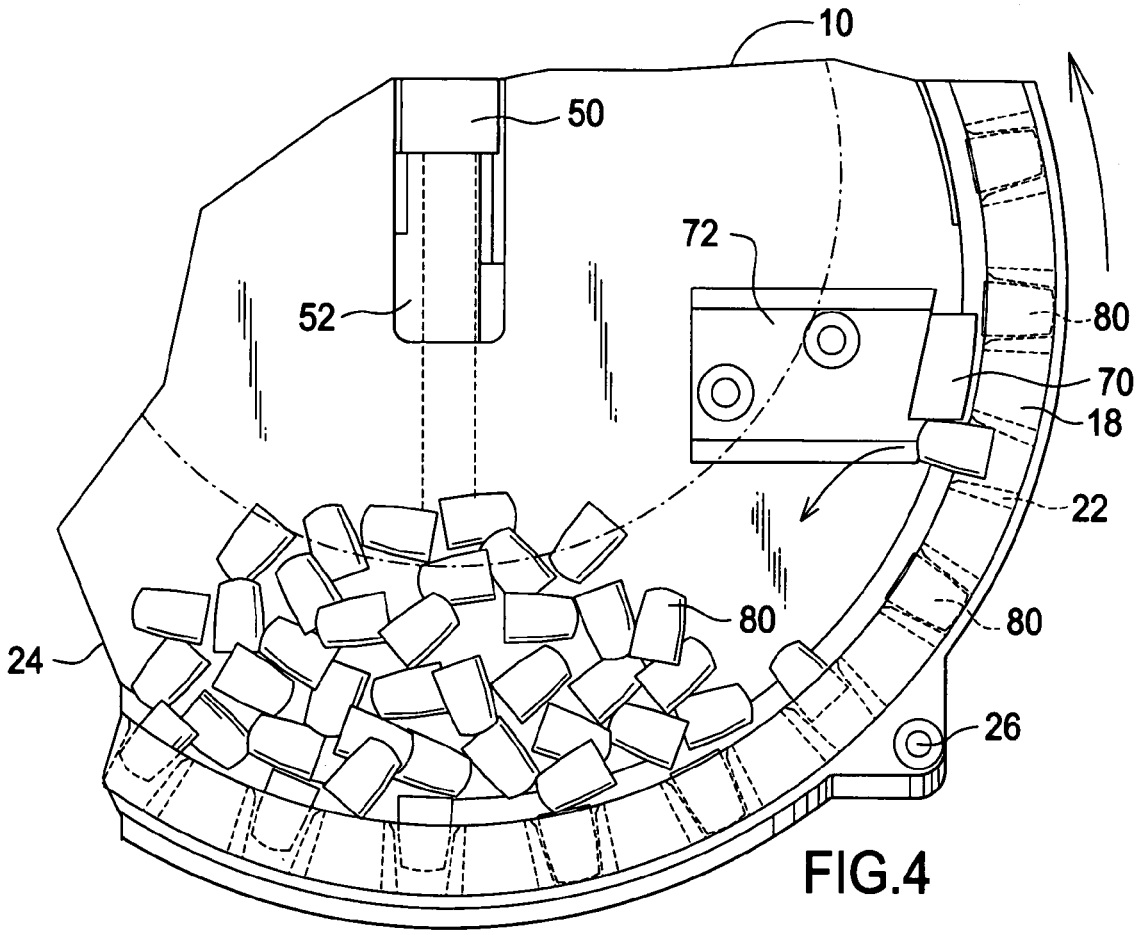
FIGS. 4 and 5 are cutaway views of a right hand portion of the rotary bullet feeder assembly of FIGS. 1-3, illustrating the way in which a bullet that is improperly oriented in one of the bullet pockets is removed therefrom by a bullet deflector tab.
Figure 5:
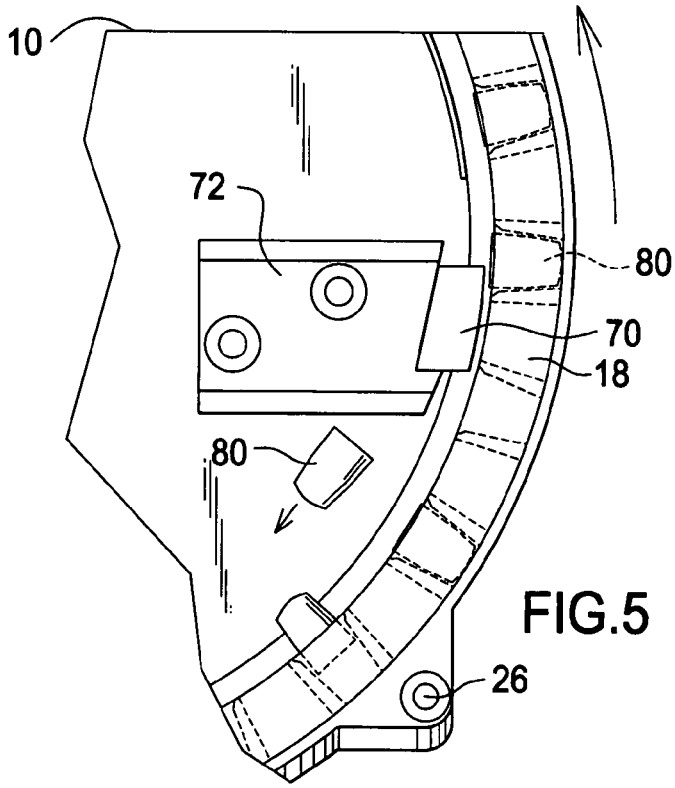
Figure 6:
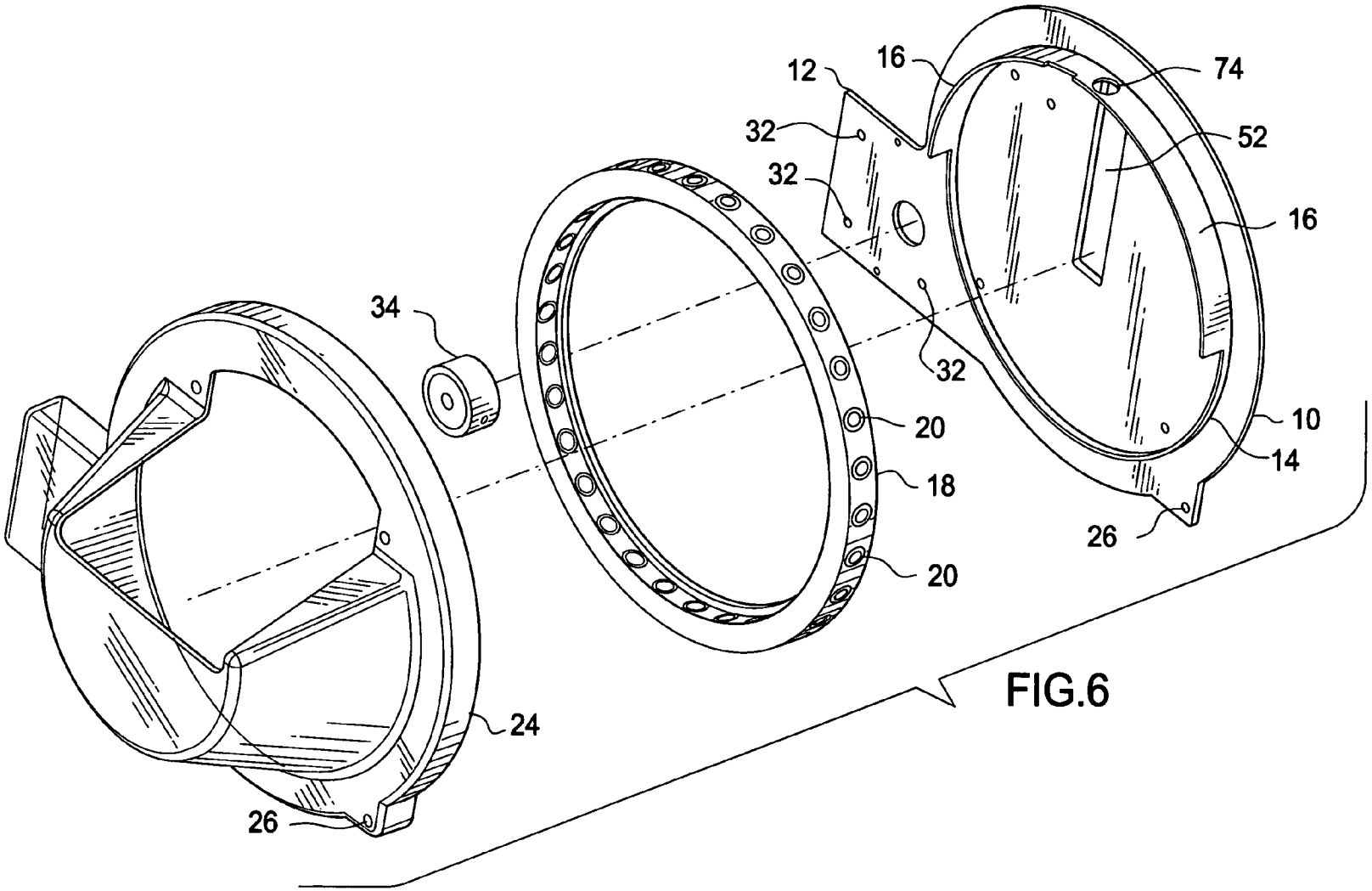
FIG. 6 is an exploded view of the bullet hopper and feed wheel assembly of the rotary bullet feeder assembly of FIGS. 1-3.

Operation of rotary bullet feeder assembly 100 is commenced by placing a supply of bullets 80 in the bullet hopper bowl 24. Motor 30 is then switched on to run in its forward direction, causing drive roller 34 to rotate in the clockwise direction, in turn driving feed ring 18 in the counterclockwise direction, as viewed from the front of bullet feeder assembly 100. Rotation of feed ring 18 causes the bullets 80 to tumble and move around within bullet hopper bowl 24, causing the bullets 80 to randomly enter various ones of the bullet pockets 22. A bullet 80 is properly oriented in one of the bullet pockets 22 if it enters nose first. Should one of the bullets 80 attempt to enter one of the bullet pockets 22 base first, that bullet will be deflected back into bullet hopper bowl 24 when it contacts a flexible deflector tab 70 that is fixedly positioned on the front surface of base plate 10 adjacent the inner surface of feed ring 18 and held in place by a deflector clamp 72 attached to the front surface of base plate 10. Deflector tab 70 may be fabricated of plastic, rubber, leather or any other suitable material. Each of the bullets 80 that is properly positioned in one of the bullet pockets 22 is prevented from falling therefrom by bullet support wall 16 of base plate 10. An opening 74 in bullet support wall 16 allows a bullet 80 to fall from the one of bullet pockets 22 in which it resides when that bullet pocket reaches the apex point along its circular route of travel. Each one of the bullets 80 falls from its bullet pocket into the top of bullet funnel 50 and continues to drop, past microswitch lever 60, and through the remaining length of bullet cavity 48. The rotary bullet feeder assembly 100 of the present invention may be connected to supply bullets that are oriented in the nose up position to the toolhead 200, illustrated in FIG. 1, that is installed in a typical commercially available, manually-operated cartridge reloading machine. When so employed rotary bullet feeder assembly 100 may supply bullets 80 exiting the bottom end of bullet cavity 48 at a rate faster than the operator of the cartridge reloading machine can accept them. In that event, bullets 80 will accumulate in bullet cavity 48 below microswitch 54, as illustrated in FIGS. 3 and 9. When bullet cavity 48 is filled with bullets 80 below microswitch 54, as shown in FIG. 9, microswitch lever 60 will be in the position shown in that figure, thereby turning off motor 30 to stop operation of rotary bullet feeding assembly 100. As bullets 80 below microswitch 54 are consumed, microswitch lever 60 will be permitted to move to its position illustrated in FIG. 8 by the bullets 80 descending down bullet cavity 48 from above microswitch 54, thereby turning on motor 30 to resume operation of rotary bullet feeder assembly 100. Operation of motor 30 will pause only momentarily each time one of the bullets 80 passes microswitch lever 60.

Referring now to FIGS. 10-14, there are shown the details of toolhead assembly 200 to which rotary bullet feeder assembly 100 is typically coupled for use. Toolhead assembly 200 includes a metal toolhead plate 202 having a locating flange 203 formed along a portion of the periphery thereof that serves to locate toolhead assembly 200 in a frame channel of the cartridge reloading machine in which it is installed. A clamp 204 receives mounting post 46 to secure rotary bullet feeder assembly 100 in place over toolhead assembly 200, as illustrated in FIGS. 1 and 7. In this mounted position, the bottom end of bullet cavity 48 of rotary bullet feeder assembly 100 is in contact with a cartridge-specific bushing 206 inserted in a circular opening in toolhead plate 202. Five threaded openings 208, 210, 212, 214, 216 in toolhead plate 202 accept dies conventionally used by the cartridge reloading machine to which toolhead assembly 200 is connected. Typically, opening 208 receives a crimp die; opening 210 receives a sizing die; opening 212 receives a powder die, opening 214 is an inspection station that receives an optional powder check die; and opening 216 receives a seating die. An additional central opening 218 serves a registration function when toolhead assembly 200 is mounted in the cartridge reloading machine.

A flat, circular bullet feedwheel 220 is horizontally mounted on the underside of toolhead plate 202 away from threaded openings 208, 210, 212, 214. As illustrated in FIGS. 10-14, a central opening 222 in bullet feedwheel 220, serving as a point of rotation thereof, is aligned with an opening 224 in toolhead plate 202. Eight caliber-specific bullet feed holes 226, arranged circularly radially equidistant outward from central opening 222, are provided in bullet feedwheel 220. In addition, eight smaller indexing holes 228, also arranged circularly radially equidistant outward from central opening 222, but less distant than bullet feed holes 226, are provided in bullet feedwheel 220. An indexing mechanism 230, mounted on the underside of toolhead plate 202, serves to incrementally rotate or index bullet feedwheel 220 in response to user actuation of the handle of the cartridge reloading machine. Indexing mechanism 230 includes an indexing lever 232 connected for rotation about a baseplate post 234. A spring-loaded index pawl 236 is provided at a distal end of indexing lever 232. Indexing pawl is coupled to a detent ball and ball spring that serves to sequentially engage each one of the indexing holes 228 in feedwheel 220. An extension spring 238, connected between indexing lever 232 and a baseplate post 240, serves to return indexing lever 232 to its quiescent position following each indexing rotation of bullet feedwheel 220.

A circular groove 242 is cut into the entire peripheral edge of bullet feedwheel 220. Circular groove 242 is cut sufficiently deep into feedwheel 220 so as to intersect a small arcuate portion of the outer periphery of each of the bullet feed holes 226. An extension spring 244 resides within circular groove 242 and, hence, in the arcuate portion of the outer periphery of each of the bullet feed holes 226 intersected by circular groove 242. Extension spring 244 thereby serves to maintain the proper position of a bullet in each of the bullet feed holes 226 by exerting a small amount of side pressure on the bullet.

In operation, bullets 80 may be manually fed to the toolhead assembly 200 by means of a simple bullet guide vertically positioned above bushing 206. Preferably, however, bullets are automatically supplied to toolhead assembly 200 by rotary bullet feeder assembly 100, coupled thereto as illustrated in FIG. 1. Whether fed manually to toolhead assembly 200 or automatically by attachment of rotary bullet feeder assembly 100 thereto, the present invention eliminates the time-consuming and otherwise disadvantageous need for manual placement of a bullet on the mouth of each cartridge case to be reloaded.

I claim:

1. A rotary bullet feeder assembly comprising:

a generally circular flat base plate, a front surface of said base plate having a circular raised boss thereon, said raised boss being spaced uniformly inwardly from a peripheral edge of said base plate, an upper portion of said boss extending further forward from said base plate to form an arcuate bullet support wall, said arcuate bullet support wall having a circular bullet exit opening at an apex thereof, said base plate having a radial slot therein extending downward from the apex of said bullet support wall;

a circular bullet feed ring having an outside diameter approximating a diameter of said base plate, said circular bullet feed ring being positioned in front of and against said base plate, said circular bullet feed ring having an inside diameter of a rearward portion thereof such that said rearward portion of said circular bullet feed ring bears against an outer peripheral surface of said raised boss when said circular bullet feed ring is positioned against said base plate, said circular bullet feed ring being supported for rotation against said base plate by said raised boss and said bullet support wall, said circular bullet feed ring having an inside diameter of a forward portion thereof greater than said inside diameter of said rearward portion thereof that bears against said raised boss to thereby form a step between inner surfaces of said forward and rearward portions of said circular bullet feed ring, said forward portion of said circular bullet feed ring having a multiplicity of equidistantly spaced circular holes extending therethrough from said stepped inner surface of said forward portion of said circular bullet feed ring to an outer surface thereof;

a bullet pocket insert fixedly positioned in each of said multiplicity of holes in said circular bullet feed ring, each bullet pocket insert having a cylindrical outer surface and having a generally tapered inner surface shaped in general correspondence with an outer surface shape of a bullet to be positioned in a nose first position therein;

a bullet hopper bowl peripherally shaped in general correspondence with said base plate, said bullet hopper bowl being fixedly attached in front of said base plate and said circular bullet feed ring, said bullet hopper bowl having a top opening therein for receiving a supply of bullets to be fed by said rotary bullet feeder assembly;

means for rotationally driving said circular bullet feed ring to thereby cause bullets contained in said bullet hopper bowl to individually randomly enter said bullet pocket inserts and be carried by rotation of said circular bullet feed ring to a position of alignment with said bullet exit opening in said bullet support wall, at which position each bullet gravitationally falls from its bullet pocket insert through said bullet exit opening in said bullet support wall;

a mounting bracket attached to a rear surface of said base plate to maintain said base plate and said bullet feed ring and bullet hopper bowl, attached thereto, in a fixed position tilted rearwardly from the vertical; and an elongated bullet guide, connected to said mounting bracket, said bullet guide being positioned vertically and having a top end located proximate said bullet exit opening in said bullet support wall for receiving bullets individually as they gravitationally fall from said bullet feed ring through said bullet exit opening in said bullet support wall, said bullet guide having a lower bullet discharge end at which bullets traveling downward through said bullet guide are supplied to an external cartridge reloading apparatus.

2. A rotary bullet feeder assembly as in claim 1, wherein:

said base plate includes a flange portion extending to one side thereof; and said means for rotationally driving said circular bullet feed ring comprises a motor attached to a rear surface of said flange portion of said base plate, said motor having a forwardly extending drive shaft and a drive roller attached to said motor drive shaft, said drive roller being positioned for frictional engagement with a peripheral surface of said bullet feed ring.

3. A rotary bullet feeder assembly as in claim 1, further comprising a microswitch attached proximate said elongated bullet guide, said microswitch being electrically connected to said means for rotationally driving said circular bullet feed ring, said microswitch having an actuating lever extending into said bullet guide for sensing the passage of each bullet downward through said bullet guide and for sensing a stoppage in the discharge of bullets through said bullet guide flow for halting rotation of said bullet feed ring until such stoppage is cleared.

4. A rotary bullet feeder assembly as in claim 1, further comprising a flexible deflector tab fixedly mounted on said front surface of said base plate adjacent said circular bullet feed ring for engaging each of said bullets that randomly enters one of said bullet pocket inserts in a base first position to thereby deflect it back into said bullet hopper bowl.

5. A rotary bullet feeder assembly as in claim 1, wherein said plurality of equidistantly spaced circular holes in said bullet feed ring comprises twenty-four holes.

6. A rotary bullet feeder and toolhead assembly for use with a progressive cartridge reloading machine, comprising:

a generally circular flat base plate, a front surface of said base plate having a circular raised boss thereon, said raised boss being spaced uniformly inwardly from a peripheral edge of said base plate, an upper portion of said boss extending further forward from said base plate to form an arcuate bullet support wall, said arcuate bullet support wall having a circular bullet exit opening at an apex thereof, said base plate having a radial slot therein extending downward from the apex of said bullet support wall;

a circular bullet feed ring having an outside diameter approximating a diameter of said base plate, said circular bullet feed ring being positioned in front of and against said base plate, said circular bullet feed ring having an inside diameter of a rearward portion thereof such that said rearward portion of said circular bullet feed ring bears against an outer peripheral surface of said raised boss when said circular bullet feed ring is positioned against said base plate, said circular bullet feed ring being supported for rotation against said base plate by said raised boss and said bullet support wall, said circular bullet feed ring having an inside diameter of a forward portion thereof greater than said inside diameter of said rearward portion thereof that bears against said raised boss to thereby form a step between inner surfaces of said forward and rearward portions of said circular bullet feed ring, said forward portion of said circular bullet feed ring having a multiplicity of equidistantly spaced circular holes extending therethrough from said stepped inner surface of said forward portion of said circular bullet feed ring to an outer surface thereof;

a bullet pocket insert fixedly positioned in each of said multiplicity of holes in said circular bullet feed ring, each bullet pocket insert having a cylindrical outer surface and having a generally tapered inner surface shaped in general correspondence with an outer surface shape of a bullet to be positioned in a nose first position therein;

a bullet hopper bowl peripherally shaped in general correspondence with said base plate, said bullet hopper bowl being fixedly attached in front of said base plate and said circular bullet feed ring, said bullet hopper bowl having a top opening therein for receiving a supply of bullets to be consumed by said cartridge reloading machine;

means for rotationally driving said circular bullet feed ring to thereby cause bullets contained in said bullet hopper bowl to individually randomly enter said bullet pocket inserts and be carried by rotation of said circular bullet feed ring to a position of alignment with said bullet exit opening in said bullet support wall, at which position each bullet gravitationally falls from its bullet pocket insert through said bullet exit opening in said bullet support wall;

a mounting bracket attached to a rear surface of said base plate to maintain said base plate and said bullet feed ring and bullet hopper bowl, attached thereto, in a fixed position tilted rearwardly from the vertical;

an elongated bullet guide, connected to said mounting bracket, said bullet guide being positioned vertically and having a top end located proximate said bullet exit opening in said bullet support wall for receiving bullets individually as they gravitationally fall from said bullet feed ring through said bullet exit opening in said bullet support wall, said bullet guide having a lower bullet discharge end at which bullets traveling downward through said bullet guide are discharged;

a toolhead plate having a locating flange formed along a portion of a peripheral edge thereof to locating said toolhead plate in a frame channel of said cartridge reloading machine, said toolhead plate having a clamp member for receiving a mounting post vertically depending from the bottom end of said bullet guide to thereby secure said bullet guide to said toolhead plate, said toolhead plate having a plurality of threaded die openings, spaced away from said clamp member, for receiving dies used by said cartridge reloading machine, one of said die openings comprising a bullet seating die opening, said toolhead plate having a bullet receiving opening adjacent said clamp member, said bullet receiving opening being aligned with said bullet guide so as to receive bullets discharged therefrom;

a flat circular bullet feedwheel horizontally mounted on the underside of said toolhead plate away from said plurality of threaded die openings, said bullet feedwheel having a central opening serving as a point of rotation thereof, said bullet feedwheel having a plurality of caliber specific circular bullet feed holes arranged circularly radially equidistant outward from said central opening, a center point of each of said plurality of bullet feed holes lying along a circle that intersects a vertical axis of said bullet receiving opening in said toolhead plate, said bullet feedwheel having a plurality of circular indexing holes equal in number to said bullet feed holes, said indexing holes being arranged circularly radially equidistant outward from said central opening, but less distant than said bullet feed holes; and an indexing mechanism mounted on the underside of said toolhead plate and beneath said bullet feedwheel for incrementally rotating said bullet feedwheel in response to user actuation of a handle of said cartridge reloading machine to thereby move a bullet previously received from said bullet guide and into one of said bullet feed holes in said bullet feedwheel, to a position of alignment with said bullet seating die opening in said toolhead plate.

7. A rotary bullet feeder and toolhead assembly for use with a progressive cartridge reloading machine as in claim 6, wherein:

said base plate includes a flange portion extending to one side thereof; and said means for rotationally driving said circular bullet feed ring comprises a motor attached to a rear surface of said flange portion of said base plate, said motor having a forwardly extending drive shaft and a drive roller attached to said motor drive shaft, said drive roller being positioned for frictional engagement with a peripheral surface of said bullet feed ring.

8. A rotary bullet feeder and toolhead assembly for use with a progressive cartridge reloading machine as in claim 6, further comprising a microswitch attached proximate said elongated bullet guide, said microswitch being electrically connected to said means for rotationally driving said circular bullet feed ring, said microswitch having an actuating lever extending into said bullet guide for sensing the passage of each bullet downward through said bullet guide and for sensing a stoppage in the discharge of bullets through said bullet guide flow for halting rotation of said bullet feed ring until such stoppage is cleared.

9. A rotary bullet feeder and toolhead assembly for use with a progressive cartridge reloading machine as in claim 6, further comprising a flexible deflector tab fixedly mounted on said front surface of said base plate adjacent said circular bullet feed ring for engaging each of said bullets that randomly enters one of said bullet pocket inserts in a base first position to thereby deflect it back into said bullet hopper bowl.

10. A rotary bullet feeder and toolhead assembly for use with a progressive cartridge reloading machine as in claim 6, wherein said bullet feedwheel includes a groove along an entire peripheral edge of said bullet feedwheel, said groove being sufficiently deep as to intersect an arcuate portion of an outer peripheral surface of each of said bullet feed holes in said bullet feedwheel, said groove receiving an extension spring for exerting a stabilizing force on bullets positioned in said bullet feed holes.

11. A rotary bullet feeder and toolhead assembly as in claim 6, wherein said plurality of equidistantly spaced circular holes in said bullet feed ring comprises twenty-four holes.

12. A rotary bullet feeder and toolhead assembly as in claim 6, wherein said pluralities of bullet feed holes and indexing holes in said bullet feedwheel each comprises eight holes.

13. A toolhead assembly for use with a progressive cartridge reloading machine, comprising:

a toolhead plate having a locating flange formed along a portion of a peripheral edge thereof to locating said toolhead plate in a frame channel of said cartridge reloading machine, said toolhead plate having a clamp member for receiving a mounting post vertically depending from the bottom end of said bullet guide to thereby secure said bullet guide to said toolhead plate, said toolhead plate having a plurality of threaded die openings, spaced away from said clamp member, for receiving dies used by said cartridge reloading machine, one of said die openings comprising a bullet seating die opening, said toolhead plate having a bullet receiving opening adjacent said clamp member, said bullet receiving opening being aligned with said bullet guide so as to receive bullets discharged therefrom;

a flat circular bullet feedwheel horizontally mounted on the underside of said toolhead plate away from said plurality of threaded die openings, said bullet feedwheel having a central opening serving as a point of rotation thereof, said bullet feedwheel having a plurality of caliber specific circular bullet feed holes arranged circularly radially equidistant outward from said central opening, a center point of each of said plurality of bullet feed holes lying along a circle that intersects a vertical axis of said bullet receiving opening in said toolhead plate, said bullet feedwheel having a plurality of circular indexing holes equal in number to said bullet feed holes, said indexing holes being arranged circularly radially equidistant outward from said central opening, but less distant than said bullet feed holes; and an indexing mechanism mounted on the underside of said toolhead plate and beneath said bullet feedwheel for incrementally rotating said bullet feedwheel in response to user actuation of a handle of said cartridge reloading machine to thereby move a bullet previously received from said bullet guide and into one of said bullet feed holes in said bullet feedwheel, to a position of alignment with said bullet seating die opening in said toolhead plate.

14. A toolhead assembly for use with a progressive cartridge reloading machine as in claim 13, wherein said bullet feedwheel includes a groove along an entire peripheral edge of said bullet feedwheel, said groove being sufficiently deep as to intersect an arcuate portion of an outer peripheral surface of each of said bullet feed holes in said bullet feedwheel, said groove receiving an extension spring for exerting a stabilizing force on bullets positioned in said bullet feed holes.

15. A toolhead assembly as in claim 13, wherein said pluralities of bullet feed holes and indexing holes in said bullet feedwheel each comprises eight holes.

* * * * *